US007190321B2

(12) United States Patent
Giaimo, III et al.

(10) Patent No.: US 7,190,321 B2
(45) Date of Patent: Mar. 13, 2007

(54) DIRECTIONAL ENHANCEMENT/RANGE EXTENDING DEVICES

(75) Inventors: Edward C. Giaimo, III, Bellevue, WA (US); Chris A. Murzanski, Issaquah, WA (US); Stephen M. Stegner, Bothell, WA (US)

(73) Assignee: Microsoft Corporation, Redmond, WA (US)

( * ) Notice: Subject to any disclaimer, the term of this patent is extended or adjusted under 35 U.S.C. 154(b) by 239 days.

(21) Appl. No.: 10/631,121

(22) Filed: Jul. 31, 2003

(65) Prior Publication Data

US 2005/0026655 A1 Feb. 3, 2005

(51) Int. Cl.
*H01Q 1/24* (2006.01)

(52) U.S. Cl. ..... 343/834; 343/702

(58) Field of Classification Search ..... 343/702, 343/833, 834, 912

See application file for complete search history.

(56) References Cited

U.S. PATENT DOCUMENTS 3,742,513 A * 6/1973 Ehrenspeck ..... 343/817
5,539,419 A * 7/1996 Ogawa et al. ..... 343/761
6,208,300 B1 * 3/2001 Johnson ..... 343/702
6,816,120 B2 * 11/2004 Kuramoto ..... 343/702

OTHER PUBLICATIONS

D-Link Systems, Inc. 2002. "Enhanced 2.4GHz (802.11b) Wireless Range Extender." 3pp. Available http://www.dlink.com/products/wireless/dw1800ap+/.

Foxlink/Microlink. 2003. "Wireless LAN Product Line Product Requirements Document (PRD)—Specification for IEEE802.11b/g Wireless LAN Radio Repeater." 21pp. MLPRD802.11b-g WLAN RF Repeater 04-04-03.DOC.

* cited by examiner

*Primary Examiner*—Michael C. Wimer
(74) *Attorney, Agent, or Firm*—Microsoft Corporation

(57) ABSTRACT

An accessory is provided for use with an existing antenna on a wireless device to improve directionality and/or signal strength. The accessory includes a conductive surface that is coupled to the existing antenna using a clip disposed on an arm that supports the reflector. The conductive surface is disposed at a quarter wavelength spacing from the existing antenna. Alternatively, the reflective surface may be made sufficiently large to reflect received wireless signals in regard to a plurality of existing antennas that are spaced apart, e.g., internal and external antennas. The reflector can optionally be curved to achieve a desired directional characteristic for the wireless signals reflected by the accessory. Also, a director can be included on the accessory to provide improved gain and directionality for the wireless signals, relative to the existing antenna system.

27 Claims, 4 Drawing Sheets

DIRECTIONAL ENHANCEMENT/RANGE EXTENDING DEVICES

FIELD OF THE INVENTION

The present invention generally pertains to an accessory for enhancing the range and/or directionality of a wireless device in a wireless network, and more specifically, pertains to an accessory that has an electromagnetic reflective surface removably positioned adjacent to an antenna of a wireless device to provide improved range/directionality relative to other wireless devices in the network.

BACKGROUND OF THE INVENTION

There are several techniques that can be used to increase the range of a wireless transmitter/receiver. If the wireless device has a removable antenna, the antenna can be changed to one that provides greater gain and directionality. However, many wireless devices have a fixed antenna that is not designed to be readily removed and replaced, or include an internal antenna, or cannot be replaced for other reasons. While the power of the signals transmitted and received might be increased by changing the RF amplifier or power supply used in the device, to achieve the desired result, it is generally not practical to modify the circuit design and power supply of a wireless device to improve its range.

Even if the antenna of a wireless device can readily be changed, there are several disadvantages to using a replacement antenna with greater gain to achieve a desired range and directionality. First, the antenna connector that facilitates use of a replacement antenna adds cost to a wireless device, which increases the initial purchase price of the device. In addition, it is often desirable to use two antennas on a wireless device to provide antenna diversity, which improves the reception capabilities of the device. But, the benefits of antenna diversity are reduced if the wireless device includes an external and internal antenna, and only the external antenna is replaced. Also, replacement antennas can be relatively expensive to purchase.

Accordingly, it would be preferable to develop an alternative approach to achieve increased range and/or directionality without replacing the existing antenna on a wireless device. Any solution to this problem should not increase the cost of the wireless device as it is normally sold, since some users may not need the increased range and directionality. Also, a solution to this problem should not adversely affect antenna diversity.

SUMMARY OF THE INVENTION

The reduction in signal strength caused by intervening walls or distance between devices communicating in a wireless system can be addressed by providing a suitable reflector that is disposed at an appropriate spacing from an existing antenna system on selected wireless devices so that the reflected signal from the reflector reinforces the signal strength of the wireless signals transmitted and received by the supplied antenna system of the device. A reflector can increase the signal strength of a signal transmitted or received by a simple antenna, such as a post antenna, and also improve the directionality of the transmitted and received signals relative to the antenna system. Different shape and size reflectors can be employed in this accessory device, depending upon the type of existing antenna system with which the accessory will be used and the intended goal of the accessory.

The accessory includes a support adapted to be removably coupled to a wireless device at a predefined distance from an existing antenna system. A conductive material disposed on the support extends over an area of sufficient size, so that when the accessory is disposed adjacent to the existing antenna system of the wireless device, the conductive surface serves as a reflector for wireless signals. The reflector thereby enhances at least one of a range and a directionality of wireless signals transmitted or received by the wireless device, without requiring that the antenna system supplied with the device be replaced.

The conductive material defines a surface extending over the support, and this surface is generally planar. Alternatively, the surface can be curved in a shape selected so that when the accessory is disposed at the predefined distance from the existing antenna system, wireless signals are directed in a desired pattern by the conductive material. In one embodiment, the surface defined by the conductive material extends over an area sufficient in size so that the surface is disposed at the predefined distance from a plurality of spaced-apart antennas comprising an existing antenna system of a wireless device.

In another embodiment, the accessory further includes a clip that is sized and shaped so as to couple the accessory to a post antenna of the wireless device. Optionally, the accessory includes a director disposed on a side of the clip opposite from the support and sized and shaped to direct a wireless signal produced or received by a wireless device.

Yet another embodiment includes a base that is sized and shaped so as to couple the accessory to a housing of a wireless device. As another option, the accessory can include means for hanging the accessory and a wireless device on a vertical surface, such as brackets on the reflector or one or more orifices extending through the reflector for accepting threaded fasteners that connect the reflector to a vertical surface.

The predefined distance between the reflector and the existing antenna is preferably about a quarter wavelength of the wireless signal produced or received by the wireless device, but may vary due to the reflecting structure used.

Another aspect of the present invention is directed to a method for increasing at least one of a range of the antenna on a wireless device and a directionality of a wireless device. The method includes steps that are generally consistent with the functions implemented by the components of the accessory described above.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENTS

Exemplary Wireless Network Illustrating Utility of Present Invention

Figure 1:
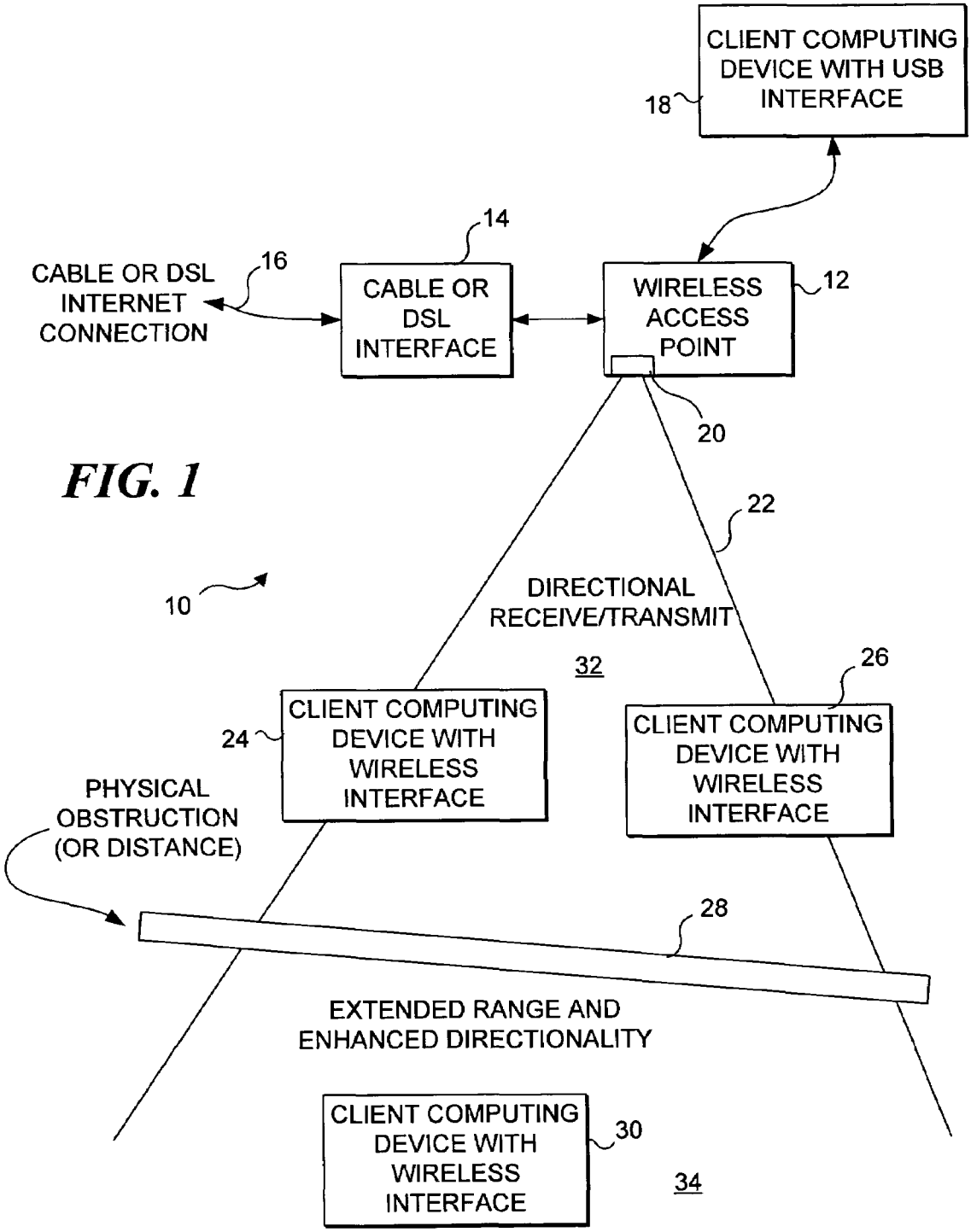
FIG. 1 is a block diagram of an exemplary wireless network illustrating how the present invention provides extended range and directional control for a wireless signal.

An exemplary wireless network 10 in FIG. 1 illustrates why the present invention is useful in certain situations where the signal strength of the wireless signals conveyed between wireless devices is inadequate if omni-directional antennas supplied with the devices are used without the present invention. Wireless network 10 is operating in accord with one of the Institute of Electrical and Electronic Engineers (IEEE) 802.11a, 802.11b, or 802.11g specifications. The specifications define the frequencies and other characteristics that affect the ability of two wireless devices to communicate with each other. The distance that such devices can successfully communicate is a function of the distance between them, and of intervening structures that reduce the strength of the wireless signals received by a wireless device from another such device.

Most wireless networks include at least one wireless access point or base station. Thus, wireless network 10 includes a wireless access point 12 that is provided with an accessory 20 (shown schematically) for improving the range and directional characteristics of the wireless signal transmitted and received by wireless access point 12 in accord with the present invention. Wireless access point 12 is coupled to a cable modem or digital subscriber line (DSL) interface 14, which in turn is connected respectively either to a cable network or a DSL enabled telephone line 16 that provides an Internet connection conveying broadband signals. Also, wireless access point 12 may be directly coupled to a client computing device 18 through a universal serial bus (USB) interface, or other suitable connections such as an Ethernet port.

Wireless access point 12 communicates with two client computing devices having a wireless interface 24 and 26. The wireless interface will typically comprise either a wireless interface card that connects to a data bus in a computing device, or a PCMCIA (Personal Computer Memory Card International Association) card of the type used in a portable computing device. These client computing devices are coupled to the Internet using wireless signals that are transmitted to and from wireless access point 12.

Client computing devices with wireless interfaces 24 and 26 are disposed within a region 32. Within region 32, the strength of the wireless signals transmitted and received by wireless access point 12 are sufficient to readily communicate with these two client computing devices using only the antenna system included with wireless access point 12. However, a client computing device with wireless interface 30 is disposed within a region 34 that has different reception and transmission characteristics than region 32. A primary cause of the different reception and transmission characteristics within region 34 is a physical obstruction 28 that is interposed between client computing device 30 and wireless access point 12. However, even without the physical obstruction, client computing device 30 might simply be disposed at too great a distance to readily communicate with wireless access point 12, given the specific limitations of the wireless interface and/or wireless access point and the frequency being employed.

Physical obstruction 28 may comprise a wall, or a plurality of walls or ceilings or other internal building structures that reduce the signal strength of wireless signals propagating through the structure in which wireless network 10 is installed. An accessory 20 in accord with the present invention is coupled to wireless access point 12 and is specifically intended to address this problem by providing enhanced directionality and extending the range of the wireless signals propagating between wireless access point 12 and client computing device 30, so that they can readily communicate with each other. Although accessory 20 is only shown coupled to wireless access point 20 it might also optionally be coupled to the wireless interface of client computing device 30. Or as a further alternative, accessory 20 might be fitted only to the wireless interface on client computing device 30 (but not on wireless access point 12). Since the accessory improves the signal strength and directionality of both transmit and receive signals, it only needs to be used on one of the two wireless devices that are communicating with each other, since both devices will benefit from the enhanced signal strength and directionality provided by the accessory.

One possible disadvantage of using accessory 20 with wireless access point 12 instead of client computing device 30 is that the signal strength is thereby reduced on the opposite side of the accessory. Thus, if another client computing device with wireless interface were disposed on the opposite side of wireless access point 12, the signal level on the opposite side might be to low to enable communication with wireless access point 12. Using the omni-directional antenna system originally supplied with wireless access point 12 would be preferable in this situation, since the signal strength would then be more uniform in all directions around wireless access point 12.

Embodiments of Adaptors for Improving Signal Strength/Directionality

Figures 2A, 2B, 2C:
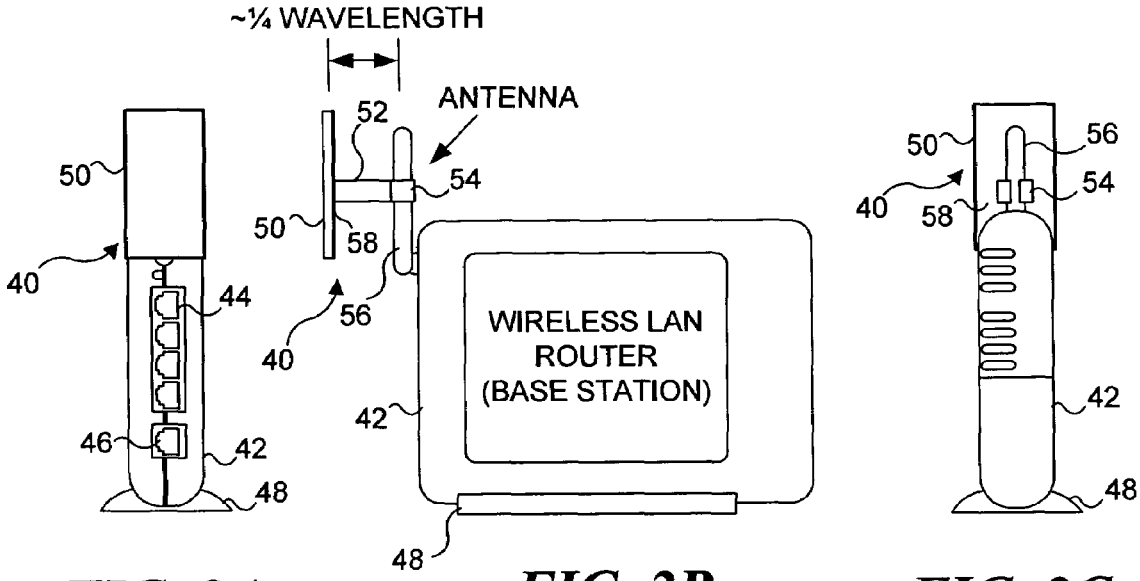
FIG. 2A is an elevational end view of a wireless device and an accessory in accord with the present invention that comprises a first embodiment.
FIG. 2B is a front elevation view of the wireless device and the first embodiment of the present invention shown in FIG. 2A.
FIG. 2C is an elevational end view of the wireless device and the first embodiment, showing the opposite end from that illustrated in FIG. 2A.

Most laptops and other portable devices employ either built-in wireless interfaces or use PCMCIA wireless interface cards that may not have a post antenna. Wireless interface cards that are designed to plug into the data bus of a conventional personal computer typically include external post antennas that are either fixed or able to rotate about one or more axes. The present invention can clearly be used with any antenna system that includes a post, but in other embodiments, can be used with antenna systems that are either completely or partly internal. FIGS. 2A, 2B, and 2C illustrate an accessory 40 in accord with the present invention that is suitable for removably coupling to such an antenna. In this case, the accessories being used with a wireless local area network (LAN) router (base station) 42 and can also function as a four port switch for a conventional Ethernet network. Wireless base station 42 includes four Ethernet ports 44 that can be connected to computing devices using conventional Ethernet cables (not shown). Also included is a wide area network (WAN) port 46, which would typically be connected to cable or DSL interface 14 (as shown in FIG. 1). This particular model of wireless LAN base station has a supporting base 48 that supports it in a vertical orientation so that an antenna 56, which extends from an end of wireless LAN base station 42 above Ethernet ports 44 can pivot. A pivotal post antenna like antenna 56 is typically provided on wireless access points and other types of wireless devices.

As more clearly shown in FIGS. 2B and 2C, accessory 40 comprises a generally rectangular reflector 50 that is connected to an arm 52 extending outwardly from reflector 50 from about its midpoint. Arm 52 is not conductive. A distal end of arm 52 includes a clip 54 that is sized and shaped to couple to antenna 56, which has a generally cylindrical elongate shape. On the surface of reflector 50 that faces antenna 56 is disposed a metallic conductive layer 58 that reflects wireless signals both to and from antenna 56 in a direction generally extending away from reflector 50 in the direction of antenna 56. As explained in greater detail below, the size and shape of reflector 50 can be modified to alter the directionality of the wireless signals reflected from the reflector relative to antenna 56. Arm 52 and clip 54 are sized and shaped to mount reflector 50 so that is disposed one-quarter wavelength away from antenna 56. Since a wireless LAN router will typically transmit and receive within a defined frequency band, the quarter wavelength required for each of the three IEEE 802.11 specifications is known, enabling the appropriate length for arm 52 to be determined for a specific LAN router using one of the specifications.

Although arm 52 is generally aligned with a longitudinal axis of wireless LAN base station 42 in the illustrations shown in FIGS. 2A–2C, it will be understood that the disposition of reflector 50 can readily be altered simply by rotating accessory 40 about the longitudinal axis of antenna 56 as desired. Also, to the extent that antenna 56 is pivotally mounted to wireless LAN base station 42, both the antenna and accessory 40 can readily be pivoted to a desired disposition to control the direction in which wireless signals are transmitted and received by antenna 56 in regard to being reflected from metallic surface 58. In addition, it should be noted that metallic surface 58 can be disposed within reflector 50, i.e., sandwiched between two layers of non-conductive material such as plastic to protect the conductive surface if desired.

Figures 3A, 3B:
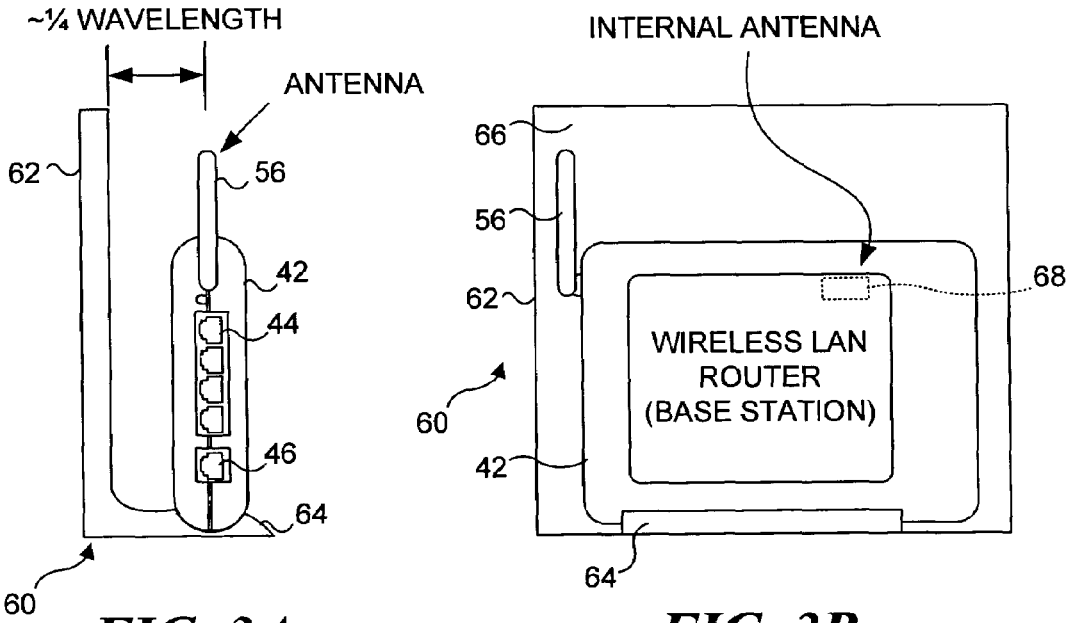
FIG. 3A is an elevational end view of a wireless device coupled to a second embodiment of the present invention.
FIG. 3B is a front elevational view of the wireless device coupled to the second embodiment of FIG. 3A.

If wireless LAN base station 42 includes an internal antenna 68, as shown in FIG. 3B, an accessory 60, which is illustrated in FIGS. 3A and 3B provides a better solution for enhancing the range and directionality of wireless signals transmitted to and received by both antenna 56 and internal antenna 68. As noted above in the Background of the Invention, use of two antennas on a wireless device provides antenna diversity, since one of the antennas may receive a signal at a lower level or signal strength than the other antenna. The antenna receiving the higher intensity signal will then automatically be selected to provide the signal for input to the wireless device. Since antenna 56 and internal antenna 68 are spaced apart, it is apparent that reflector 50, which was described in connection with FIGS. 2A–2C, cannot provide enhanced directionality and signal strength for both antennas 56 and 68. Accordingly, accessory 60 is used, since it has a substantially larger reflector 62 that extends over an area sufficient to reflect signals to and from both antenna 56 and internal antenna 68. A conductive layer 66 is disposed on the surface of reflector 62, facing toward antennas 56 and 68. Conductive layer 66 thus reflects the wireless signals that are transmitted from antenna 56 or received by either antenna 56 or internal antenna 68. Adaptor 60 includes a base 64 that couples to the bottom of wireless LAN base station 42, supporting both accessory 60 and the wireless LAN base station in a vertical orientation, as shown in FIGS. 3A and 3B.

Figure 4:
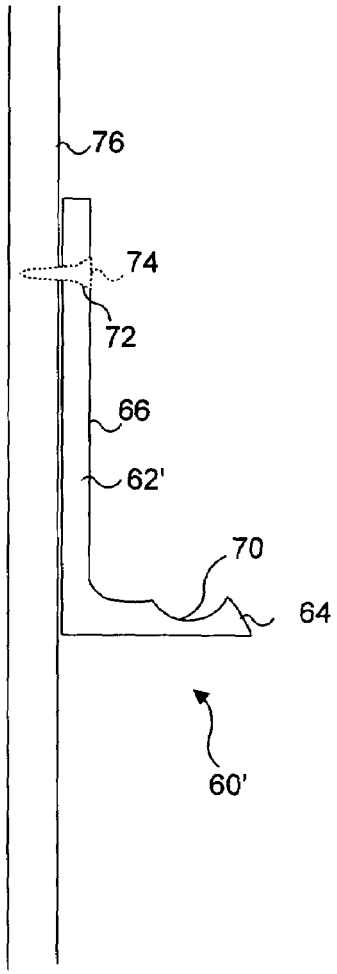
FIG. 4 is an end elevational view of a first modified second embodiment that includes an orifice used to mount the accessory to a vertical surface such as a wall.
Figure 5:
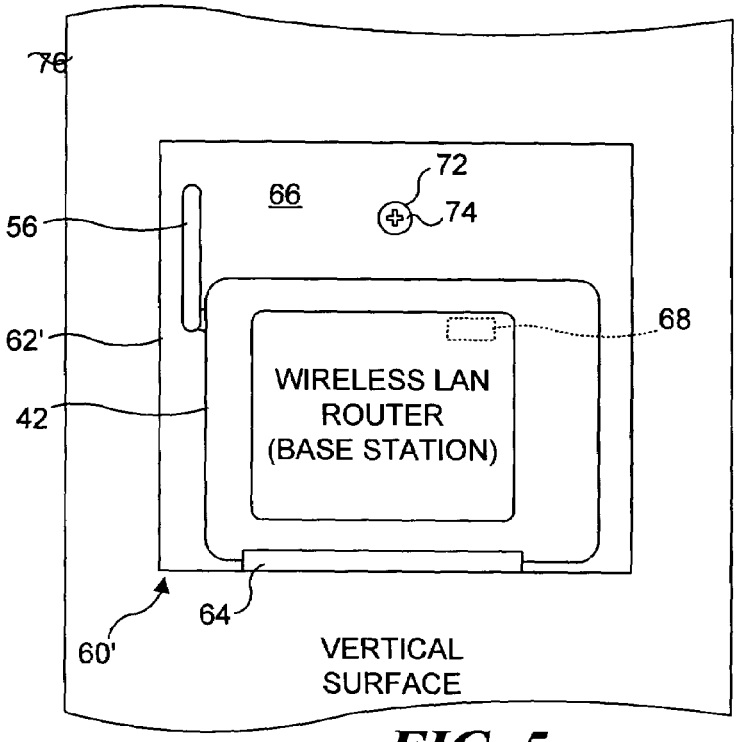
FIG. 5 is a front elevational view of the first modified second embodiment of FIG. 4, mounted to a vertical surface.

FIG. 4 illustrates an accessory 60' that is generally identical to accessory 60, except that it includes an orifice 72 sized to receive a threaded fastener 74 used to couple the accessory to a vertical surface 76, such as a wall. Although only a single orifice 72 and threaded fastener 74 are illustrated, it will be understood that a plurality of such orifices and threaded fasteners can instead be used at spaced apart locations on the reflector to ensure the stability of accessory 60'. Clearly, a requirement for use of accessory 60' is that conductive surface 66 of a reflector 62', which includes orifice 72, be oriented to face in the direction from which and to which wireless signals are to be respectively received and transmitted, relative to the antennas of wireless LAN base station 42. FIG. 5 illustrates accessory 60' coupled to vertical surface 76 to receive and transmit wireless signals in a direction generally perpendicular to conductive surface 66.

Figure 6:
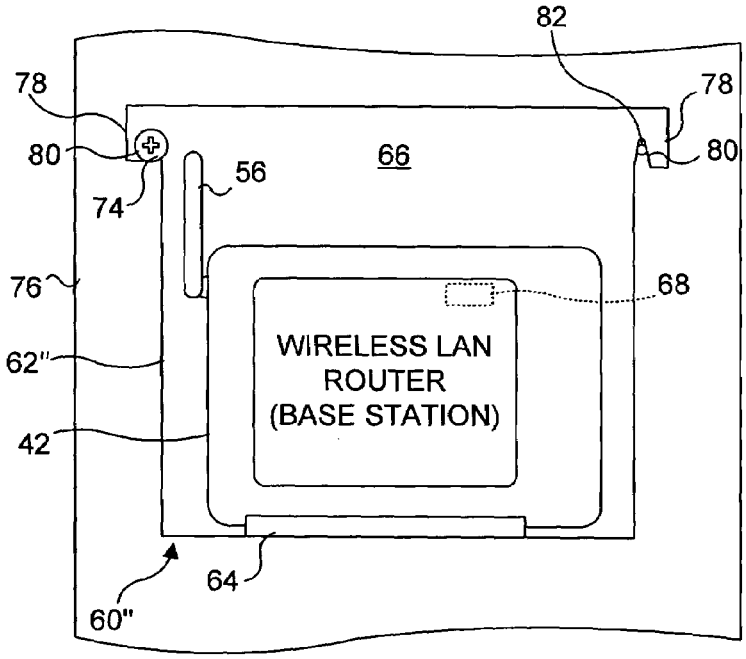
FIG. 6 illustrates a second modified second embodiment that includes brackets for mounting the accessory to a vertical surface.

A further alternative accessory 60" is shown in FIG. 6. This accessory is also similar to accessory 60, except that it includes brackets 78, which extend outwardly from opposite sides at the top of a reflector 62". Each bracket 78 defines a slot 80 that is engaged with a threaded fastener 74, only one of which is shown. An orifice 82 is shown within vertical surface 76 on the opposite side of the reflector and is disposed to receive another threaded fastener (not shown). It will be apparent that the threaded fasteners disposed in brackets 78 on each side of reflector 62" thus provide support for both the accessory and the wireless LAN base station that is mounted within a slot 70, as shown in FIG. 4.

Figure 7A:
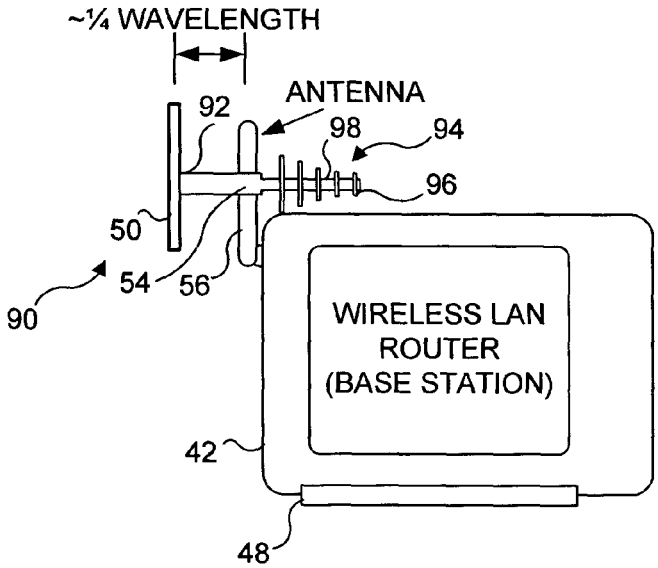
FIG. 7A is a side elevational view of a third embodiment of the present invention that includes a director, showing how it is mounted to an existing antenna of a wireless device.
Figure 7B:
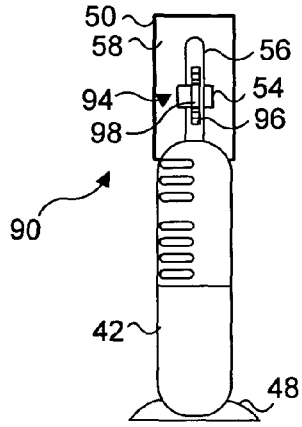
FIG. 7B is an end elevational view of the wireless device of FIG. 7A, showing the third embodiment mounted to the existing antenna of the wireless device.

Turning now to FIGS. 7A and 7B, an accessory 90 is illustrated that is similar to accessory 40. However, accessory 90 includes an arm 92 having a director 94. Accessory 90 is otherwise configured like accessory 40 and includes a clip 54 for attaching the accessory to antenna 56. Director 94 includes a plurality of conductive bars disposed at spaced-apart intervals along an extension 98 of arm 92 (which is not conductive). The spacing between bars 96 is selected to provide greater gain and directionality in a signal received and transmitted by accessory 90. Accessory 90 can also be rotated about the longitudinal axis of antenna 56, and the antenna and accessory can be pivoted to the extent enabled by the system used for mounting antenna 56 to wireless LAN base station 42. The amount of directionality required for a particular application depends upon the need for increased signal strength within a known limited dispersion angle. Accordingly, the enhanced directionality of director 94 may be appropriate only for specific circumstances in which the wireless signal can be limited to a relatively limited angle.

Figure 8A:
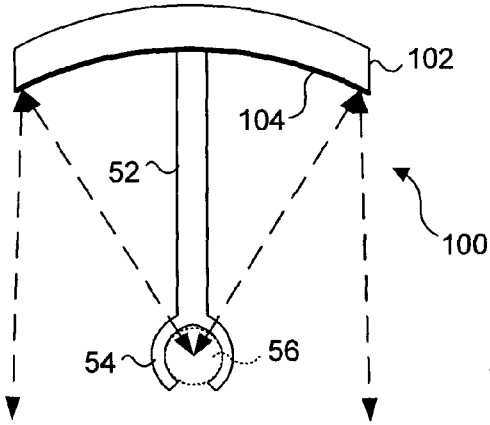
FIG. 8A is a top plan view of a fourth embodiment (similar to the first and third embodiments), which is curved to provide an enhanced directionality to the wireless signal.
Figure 8B:
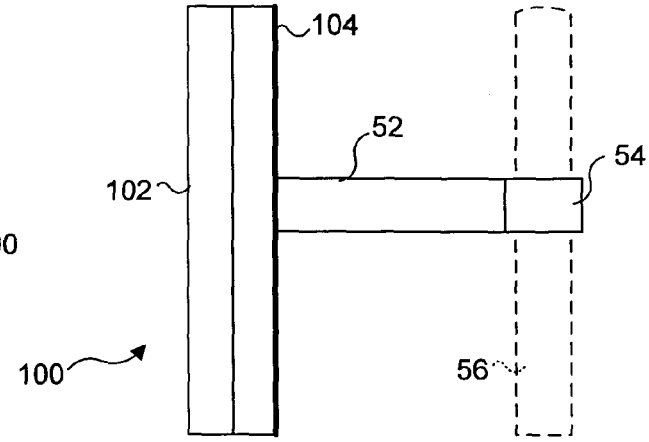
FIG. 8B is a side elevational view of the fourth embodiment of FIG. 8A.
Figure 8C:
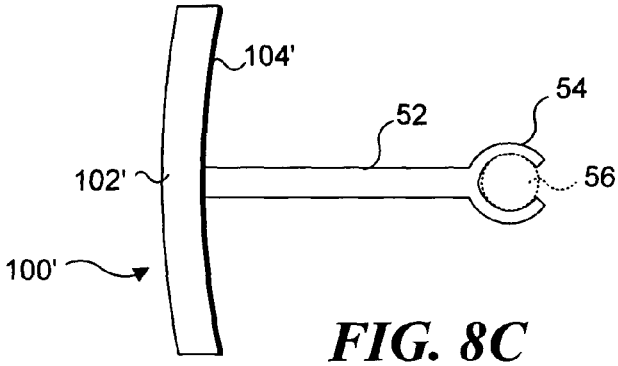
FIG. 8C is a top plan view of a modified fourth embodiment having a different curved surface to alter the enhanced directionality of the fourth embodiment.

Yet another approach for increasing the directionality of the accessory in accord with the present invention is illustrated in FIGS. 8A, 8B, and 8C. In FIGS. 8A and 8B, an accessory 100 is shown that is similar to accessory 40, except reflector 102 is curved, forming a concave surface directed toward antenna 56, when the accessory is mounted to the antenna. Similarly, a conductive layer 104 is formed on the surface of reflector 102, facing toward antenna 56 and has the same concave shape of the reflector. The dashed arrows shown in FIG. 8A illustrate how the curved shape of conductive surface 104 serves to focus the wireless signals that are transmitted and received relative to antenna 56. Preferably, the shape of reflector 102 and conductive surface 104 is selected to be a portion of a parabola. However, less directionality may be desirable in some instances. If so, it may be appropriate to employ an accessory 100' illustrated in FIG. 8C, which has a less concave shape for a reflector 102' and a conductive layer 104'. It should be evident that accessory 100' provides less directionality than accessory 100.

For providing greater dispersion of a wireless signal in a general direction, a convex surface might also be used for the reflector instead of a concave surface. Accordingly, it is not intended that the shapes used for the reflector and conductive layer in any way be limited to the examples illustrated in the drawings.

Although the present invention has been described in connection with the preferred form of practicing it and modifications thereto, those of ordinary skill in the art will understand that many other modifications can be made thereto within the scope of the claims that follow. Accordingly, it is not intended that the scope of the present invention in any way be limited by the above description, but instead be determined entirely by reference to the claims that follow.

The invention claimed is:

1. An accessory for use with one of an existing external antenna system and an existing internal antenna system of a wireless device to provide an increased range and to control directional characteristics of wireless signals that are transmitted and received by the wireless device, comprising:

(a) a support adapted to be removably coupled and physically mounted to a wireless device at a predefined distance relative to a wavelength of the wireless signals, from an existing antenna system thereof; and (b) a conductive material disposed on the support and extending over an area of sufficient size to define a conductive surface, so that when the accessory is disposed adjacent to an existing antenna system of a wireless device, the conductive surface serves as a reflector for wireless signals to enhance at least one of a range and directionality of wireless signals transmitted or received by the wireless device, thereby enabling the range and directionality of wireless signals that are transmitted and received, to be enhanced by the accessory, wherein the support is formed and thereby adapted to be removably coupled and physically mounted to the wireless device in a configuration selected from the group consisting of:

(i) a first configuration in which the support is adapted to removably mount on and be fully supported by an existing external antenna that comprises the existing antenna system, where the existing external antenna is directly affixed to and extends from the wireless device, and in which the support is formed so that the conductive material is disposed at the predefined distance from the existing external antenna when the support is mounted on the existing external antenna; and (ii) a second configuration in which the support is adapted to couple with a housing of a wireless device and to thereby orient a disposition of each of the wireless device, the conductive material, and the existing antenna system, so that the conductive material is disposed at the predefined distance from the existing antenna system.

2. The accessory of claim 1, wherein the conductive material defines a surface extending over the support.

3. The accessory of claim 2, wherein the surface defined by the conductive material is generally planar.

4. The accessory of claim 2, wherein the surface defined by the conductive material is curved in a shape selected so that when the accessory is disposed at the predefined distance from an existing antenna system, wireless signals are directed in a desired pattern by the conductive material.

5. The accessory of claim 2, wherein the surface defined by the conductive material extends over an area sufficient in size so that the surface is disposed at the predefined distance from a plurality of antennas comprising an existing antenna system of a wireless device.

6. The accessory of claim 1, further comprising a clip that is sized and shaped so as to couple the accessory to an antenna of a wireless device, wherein the antenna comprises an existing external antenna of the wireless device.

7. The accessory of claim 6, wherein the clip includes a director disposed on a side of the clip opposite from the support and sized and shaped to direct a wireless signal produced or received by a wireless device.

8. The accessory of claim 1, wherein the support comprises a base that is sized and shaped so as to couple the accessory to a housing of a wireless device.

9. The accessory of claim 1, further comprising a fixture for hanging the accessory and a wireless device from a vertical surface.

10. The accessory of claim 1, wherein the predefined distance comprises about a quarter wavelength of a wireless signal produced or received by a wireless device.

11. A method of increasing at least one of a range and a directionality of a wireless device, comprising the steps of:

(a) providing a conductive surface on a support; and (b) removably physically mounting the support for the conductive surface to the wireless device, at a predefined distance relative to a wireless signal used by the wireless device, from an existing antenna system of the wireless device, so that when the support is physically mounted to the wireless device, the conductive surface acts as a reflector of a wireless signal produced or received by the wireless device, thereby increasing at least one of the range and the directionality of the wireless signal produced or received by the wireless device, wherein the step of removably physically mounting the support for the conductive surface to the wireless device comprises one of the following steps:

(i) removably mounting the support to an existing external antenna that comprises at least a portion of the existing antenna system, where the existing external antenna is directly affixed to and extends from the wireless device, the support being formed so that the conductive surface is disposed at the predefined distance from the existing external antenna when the support is mounted to the existing external antenna; and (ii) coupling the support with a housing of the wireless device, the support orienting a disposition of the wireless device and the existing antenna system relative to the conductive surface, so that the conductive surface is disposed at the predefined distance from the existing antenna system.

12. The method of claim 11, further comprising the step of curving the conductive surface in a shape selected so that when the conductive surface is disposed at the predefined distance from the existing antenna system on the wireless device, wireless signals are directed in a desired pattern by the conductive surface.

13. The method of claim 11, further comprising the step of extending the conductive surface over an area sufficient in size so that the conductive surface is disposed at the predefined distance from a plurality of antennas comprising the existing antenna system of the wireless device.

14. The method of claim 11, further comprising the step of enabling the support for the conductive surface to mount on and be fully supported by an antenna that is directly connected to a side of the wireless device and which comprises an existing external antenna of the wireless device, so that the support is cantilevered from the antenna.

15. The method of claim 11, further comprising the step of enabling a base of the support for the conductive surface to couple with the housing of the wireless device, so that the wireless device is supported thereby.

16. The method of claim 11, further comprising the step of enabling the support for the conductive surface to be employed to attach the conductive surface and the wireless device to a vertical surface.

17. The method of claim 11, further comprising the step of including a director for the wireless signals, said director extending beyond an existing external antenna and being supported by a clip that attaches one of the support for the conductive surface and the director, to the existing external antenna.

18. The method of claim 11, wherein the predefined distance is equal to about one quarter wavelength of the wireless signal transmitted or received by the wireless device.

19. An accessory for use with an existing antenna system of a wireless device, the wireless device electronically generating wireless signals for transmission by the existing antenna system and processing wireless signals received by the existing antenna system, the accessory comprising:

(a) a conductive surface; and (b) a support having means for removably coupling the conductive surface to a wireless device and maintaining the conductive surface at a predefined distance relative to a wavelength of the wireless signals, from an existing antenna system of a wireless device, so that a wireless signal transmitted or received by a wireless device is reflected with at least one of an extended range and a desired directional characteristic, thereby enabling the at least one of the extended range and the desired directional characteristic of a wireless signal transmitted or received by at least one of an existing internal antenna system and an existing external antenna system to be wirelessly enhanced by the accessory, wherein the support is formed and thereby adapted to be removably coupled and physically mounted to a wireless device in a configuration selected from the group consisting of:

(i) a first configuration in which the support is adapted to removably mount on and be fully supported by an existing external antenna that comprises the existing antenna system, where the existing external antenna is directly affixed to and extends from the wireless device, in which the support is formed so that the conductive material is disposed at the predefined distance from the existing external antenna when the support is mounted on the existing external antenna; and (ii) a second configuration in which the support is adapted to couple with a housing of a wireless device and to thereby orient a disposition of each of the wireless device, the conductive surface, and the existing antenna system, so that the conductive surface is disposed at the predefined distance from the existing antenna system.

20. The accessory of claim 19, wherein the conductive surface is curved to focus a wireless signal relative to an existing antenna system of a wireless device.

21. The accessory of claim 19, wherein the conductive surface is generally planar and extends over an area sufficient to overlap antennas of an existing antenna system of a wireless device.

22. The accessory of claim 19, further comprising a director that extends opposite the conductive surface, said accessory being supported by a clip that is coupled to an existing external antenna of a wireless device, said director providing at least one enhancement selected from the group consisting of an increased gain, and a desired directional characteristic for a wireless signal produced by a wireless device.

23. The accessory of claim 19, wherein the support includes at least one bracket for mounting the accessory to a vertical surface.

24. The accessory of claim 19, wherein the means for removably coupling the conductive surface to a wireless device include an arm that is shaped to clip to an antenna of an existing external antenna system of a wireless device.

25. The accessory of claim 19, wherein the means for removably coupling the conductive surface to a wireless device include a bracket having a shape adapted to receive and connect to a housing of a wireless device.

26. The accessory of claim 19, wherein the conductive surface is sized and shaped to reflect wireless signals relative to both an existing internal antenna and an existing external antenna of a wireless device.

27. The accessory of claim 19, wherein the conductive surface comprises a metallic layer on the support.

* * * * *